US009732956B2

(12) United States Patent
Benedict

(10) Patent No.: US 9,732,956 B2
(45) Date of Patent: Aug. 15, 2017

(54) ILLUMINATED SLACKLINE

(71) Applicant: Neil William Benedict, Inverness, IL (US)

(72) Inventor: Neil William Benedict, Inverness, IL (US)

( * ) Notice: Subject to any disclaimer, the term of this patent is extended or adjusted under 35 U.S.C. 154(b) by 255 days.

(21) Appl. No.: 14/631,444

(22) Filed: Feb. 25, 2015

(65) Prior Publication Data

US 2016/0245503 A1 Aug. 25, 2016

(51) Int. Cl.

| | |
|---|---|
| ***F21V 33/00*** | (2006.01) |
| ***A63B 7/08*** | (2006.01) |
| *F21V 23/00* | (2015.01) |
| *F21W 131/40* | (2006.01) |
| *F21Y 103/10* | (2016.01) |
| *F21Y 115/10* | (2016.01) |

(52) U.S. Cl.

CPC ..... *F21V 33/008* (2013.01); *A63B 7/085* (2013.01); *F21V 23/008* (2013.01); *F21V 23/003* (2013.01); *F21W 2131/40* (2013.01); *F21Y 2103/10* (2016.08); *F21Y 2115/10* (2016.08)

(58) Field of Classification Search

CPC ..... A63B 7/085; A63B 7/08; F21V 33/00; F21V 33/008

See application file for complete search history.

(56) References Cited

U.S. PATENT DOCUMENTS

| | | | | |
|---|---|---|---|---|
| 993,251 | A | 5/1911 | Howard | |
| 1,419,191 | A | 6/1922 | Acker | |
| 3,545,747 | A | 12/1970 | Thomas | |
| 3,580,568 | A | 5/1971 | Stone | |
| 5,180,349 | A | 1/1993 | Marcus | |
| 6,394,623 | B1 * | 5/2002 | Tsui | F21S 4/26 362/235 |
| 2003/0095404 | A1 | 5/2003 | Becks et al. | |
| 2008/0312043 | A1 | 12/2008 | Cook | |

(Continued)

FOREIGN PATENT DOCUMENTS

| | | | |
|---|---|---|---|
| WO | WO2012/055054 | A1 | 5/2012 |
| WO | WO2012/085292 | A1 | 6/2012 |

OTHER PUBLICATIONS

International Search Report in related PCT/US2016/013218.

(Continued)

*Primary Examiner* — Karabi Guharay
(74) *Attorney, Agent, or Firm* — George Pappas

(57) ABSTRACT

An illuminated slackline is made of an elongate tube which is formed by a translucent wall. The tube is longitudinally elastic and defines an elongate enclosed space. An elongate light emitting device within the enclosed space emits light which travels through the tube wall and illuminates the slackline. A power cord extends from the device through a slackline terminal securement loop to a power source/lighting power control device which powers and controls the intensity, color and frequency of the emitted light. A friction reducing translucent tube around the device allows the device to slide within the tube elongate enclosed space. A power cord tension relief device in the enclosed space expands to prevent tension on the power cord. Tension in the device and the power cord is thereby prevented as the elongate tube longitudinally expands relative to the device and power cord.

27 Claims, 3 Drawing Sheets

(56) References Cited

U.S. PATENT DOCUMENTS

| | | | | |
|---|---|---|---|---|
| 2010/0179029 | A1 | 7/2010 | Ochi | |
| 2010/0302773 | A1 | 12/2010 | Kokoski et al. | |
| 2012/0238421 | A1 | 9/2012 | Klopman et al. | |
| 2013/0288860 | A1* | 10/2013 | Massey | A63B 5/20 482/82 |
| 2014/0329653 | A1 | 11/2014 | Klopman | |

OTHER PUBLICATIONS

Written Opinion of the International Searching Authority in related PCT/US2016/013218.

Wyss, 2013 prototype test over the GITD skatebowl in Vassiviére France of phosphorus painted glow-in-the-dark slackline.

* cited by examiner

ILLUMINATED SLACKLINE

BACKGROUND OF THE INVENTION

1. Field of the Invention

The present invention relates to the field of slacklining. More particularly, the present invention relates to slacklines which are made of elongate webbing and are secured to and tensioned between two anchors, and which are used by people balancing thereon, i.e., standing, walking, doing tricks, etc. thereon.

2. Background

Slacklines are today commonly used for entertainment, exercise and fitness purposes by people who balance, i.e., stand, walk, and do tricks, etc. thereon.

The slackline typically comprises a 1 inch to 2 inch wide elongate webbing, and is typically 30 to 100 feet long. The webbing is typically made of woven nylon or polyester and is constructed as an elongate flattened tube. The slackline is secured to and is tensioned between two anchors such as trees. A ratchet or other tensioning device is typically provided between one end of the slackline and one of the anchors for tensioning the slackline.

Hence, slacklines are similar to tightropes which have yet longer been used by tensioning between two anchors and balancing, walking and doing tricks thereon. However, slacklines are typically longitudinally more elastic than tightropes and/or are not tensioned as much as tightropes, thereby providing some "slack" in the line. Consequently, when a person balances and places weight/a downward force on a slackline, a more pronounced "V" is apparent in the slackline as it extends from each anchor at an angle downwardly to the person thereon. Additionally, as the downward force on the slackline changes, such as by the person jumping thereon, the slackline flexes more than tightropes. The slackline essentially stretches and retracts more than tightropes.

Although slacklines are functionally sufficient, a need exists and it is desirable to enhance the entertainment value of slacklines to those using the slackline and those who watch the person on the slackline.

SUMMARY OF THE INVENTION

In one form thereof the present invention is directed to a slackline for securing to and tensioning between two anchors for a person to balance thereon. The slackline includes an elongate tube formed by a translucent wall defining an elongate enclosed space. A light emitting device is provided within the elongate enclosed space whereby tight emitted by the device travels through the tube wall.

Preferably: the tube wall is flattened defining a pair of adjacent parallel elongate walls between and joined along elongate fold lines; the tube wall is made of one or more of woven nylon and polyester; the light emitting device comprises an elongate strip of a plurality of LED's; the light emitting device is elongate and is received within a friction reducing translucent tube; an electric power source is connected to the light emitting device with an electric power cord extending through the elongate tube; the elongate tube is longitudinally elastic; and, a tensioning device is provided between one end of the elongate tube and one of the anchors.

Also preferably, the slackline includes an electric power source connected to the light emitting device with an electric power cord extending through the elongate tube. An extension spring is secured at its ends to respective first and second attachment points along the power cord, and the length of the power cord between the attachment points is longer than the length of the spring between the attachment points when the spring is not extended.

The slackline can include an electric power source connected to the light emitting device with an electric power cord extending through an open end of the elongate tube and through the elongate tube. The elongate tube and power cord extending therethrough adjacent the open are tied into a loop.

The slackline can also include a lighting power control device connected to the light emitting device and selectively providing power to the light emitting device, whereby one or more of an intensity, color and frequency of the light being emitted is selectively altered.

The slackline can be used by a person by securing one end of the elongate tube to a first anchor and the other end of the elongate tube to a second anchor; tensioning the elongate tube between the anchors; and, balancing on the elongate tube while light is emitted by the device and travels through the elongate tube wall.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
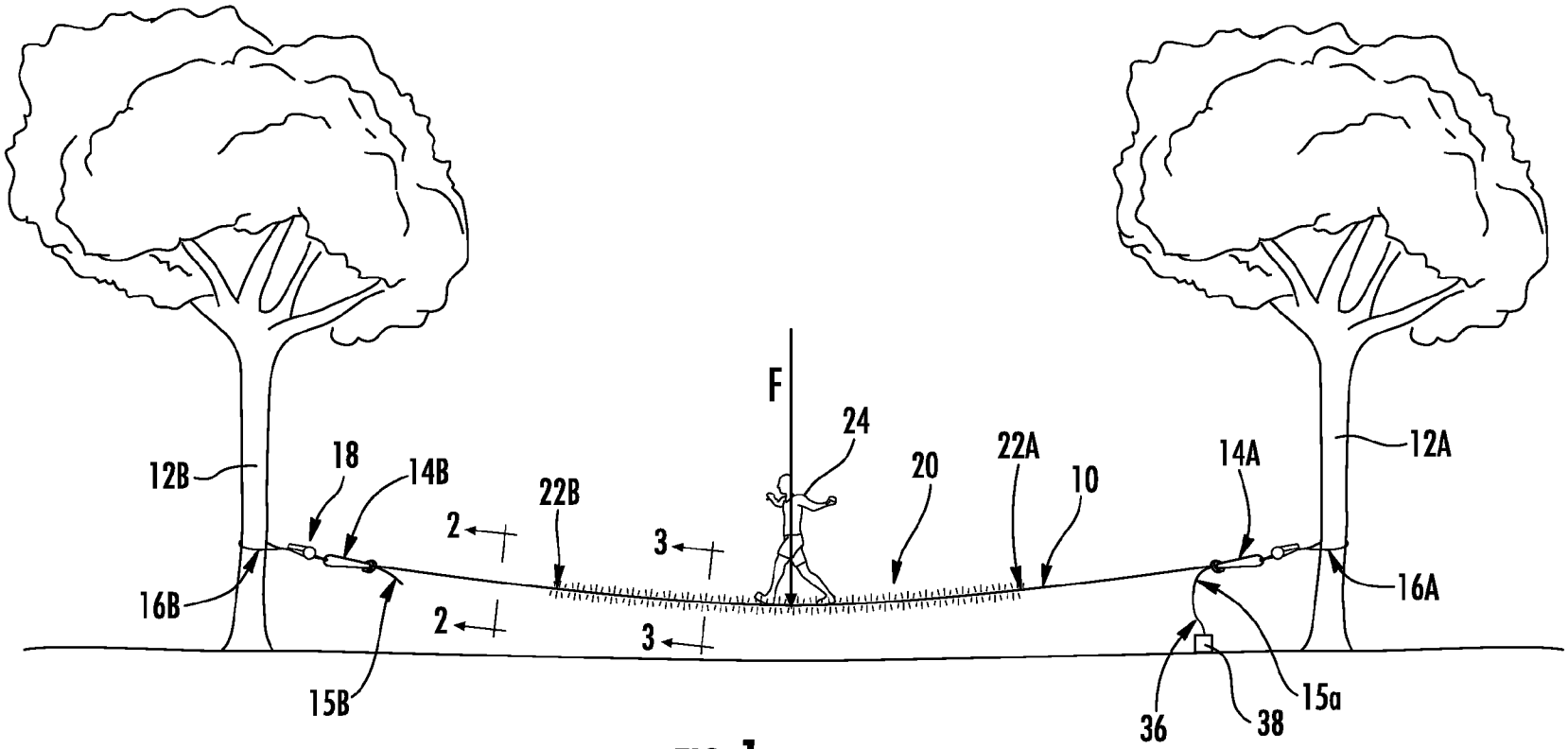
FIG. 1 is a diagrammatic view of an illuminated slackline constructed in accordance with the principals of the present invention and in use while anchored between two trees.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

Referring initially to FIG. 1, a slackline constructed in accordance with the principles of the present invention is shown and generally designated by the numeral 10. Slackline 10 is secured to and tensioned between trees 12A and 12B which serve as anchors, although any other anchors can be used as is known and customary in the field of slacklining such as, for example, posts, telephone poles, rocks, screw anchors, vehicles, etc.

The slackline 10 is tied into loops 14A, 14B adjacent its terminal ends 15A, 15B. Loop 14A is secured to a tree sling 16A wrapped around tree 12A. Loop 14A is attached to tree sling 16A with a carabiner loop and/or in other ways as is customary in the field of slacklining. Loop 14B is secured to a tensioning device such as a ratchet strap 18 which is, in turn, secured to tree sling 16B wrapped around tree 12B. The attachment of loop 14B to ratchet strap 18 and the attachment of the ratchet strap 18 to tree sling 16B are similarly made with a carabiner loops and/or in other ways as is customary in the field of slacklining. The ratchet 18 is used for tensioning the slackline 10 between trees 14A, 14B as may be desired and for safely releasing the tension in a known and customary manner and as is customary in the field of slacklining. It is noted that, alternatively, the loop 14B can be omitted and the terminal end 15B of the slackline 10 can be fed directly into the ratchet 18 for thereby tensioning and releasing the slackline 10 as needed and desired.

Slackline 10 is improved over prior known slacklines in that it is illuminated in the central area 20 between illumination end points 22A, 22B. More particularly, slackline 10 is illuminated with a means for emitting light from the slackline as described hereinbelow and in the drawings. Light emitted from the slackline is diagrammatically depicted in FIG. 1 in the area 20 between illumination end points 22A, 22B and is visible to the person 24 balancing thereon as well as other persons nearby. Of course, more or less of the slackline length can be illuminated and, indeed, it is contemplated that the entire slackline from loop 14A to loop 14B can be illuminated is so desired.

Figure 3:
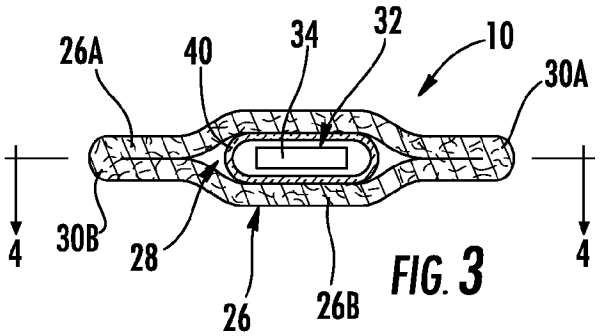
FIG. 3 is a cross sectional view of the slackline shown in FIG. 1 and taken along line 3-3 within the illuminated central area.
Figure 2:
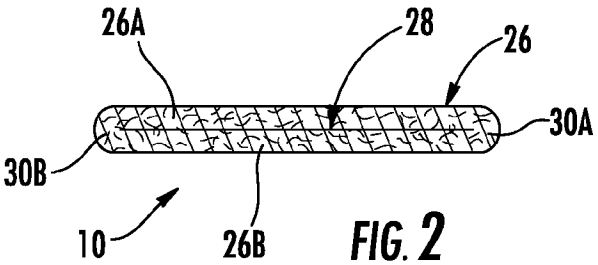
FIG. 2 is a is a cross sectional view of the slackline shown in FIG. 1 and taken along line 2-2 outside of the illuminated central area.

Referring now also to FIGS. 2-5, slackline 10 is in the form of an elongate tube or webbing formed of a flexible tube wall 26 which surrounds and defines an elongate enclosed space 28. Tube wall 26 is made of woven nylon and/or polyester and is translucent. Tube wall 26 is longitudinally moderately elastic. As shown in FIGS. 2 and 3, the tube wall 26 is flattened thereby defiling a pair of adjacent parallel elongate walls 26A, 26B which are joined along elongate fold lines 30A, 30B. The terminal ends 15A, 15B of the tube wall 26 are open and the enclosed space 28 is accessible therethrough.

A light emitting device 32 is located within the enclosed space 28 whereby light emitted therefrom travels through the translucent tube wall 26. Preferably, the light emitting device 32 is an elongate strip of a plurality of light emitting diodes (LED's) 34 such as those which are today commonly available, LED's strip 34 is made of flexible rubber material and includes red LED's 34R, green LED's 34G and blue LED's 34B. A flexible power cord 36 is connected to the LED's strip 34 and includes conductors (not shown) which are connected to the respective 34R, 34G and 34B LED's. By providing low DC power, in a known and customary manner, to the conductors of the power cord 36, the respective 34R, 34G and 34B LED's can be illuminated separately and/or together as needed or desired for thereby emitting light and varying the color, intensity and/or frequency thereof.

Power cord 36 extends through the enclosed space 28 and out of the tube 26 through terminal open end 15A whereat it extends to and is connected to an electric power source/lighting power control device 38 such as those which are today commonly available. The power source/lighting power control device 38 is connected to the conductors of the power cord 36 and can be programmed and/or can be controlled remotely as needed or desired, in a known and customary fashion, for energizing the 34R, 34B and 34G LED's and varying and altering the intensity, color and frequency of the light emitted therefrom.

The LED's strip 34 is preferably received and enclosed within a friction reducing translucent tube 40. Tube 40 is preferably made of silk or other similar low friction materials which are sufficiently thin and/or have characteristics so as to be translucent and thereby allow light being emitted by the light emitting device 32 to travel therethrough.

Figure 4:
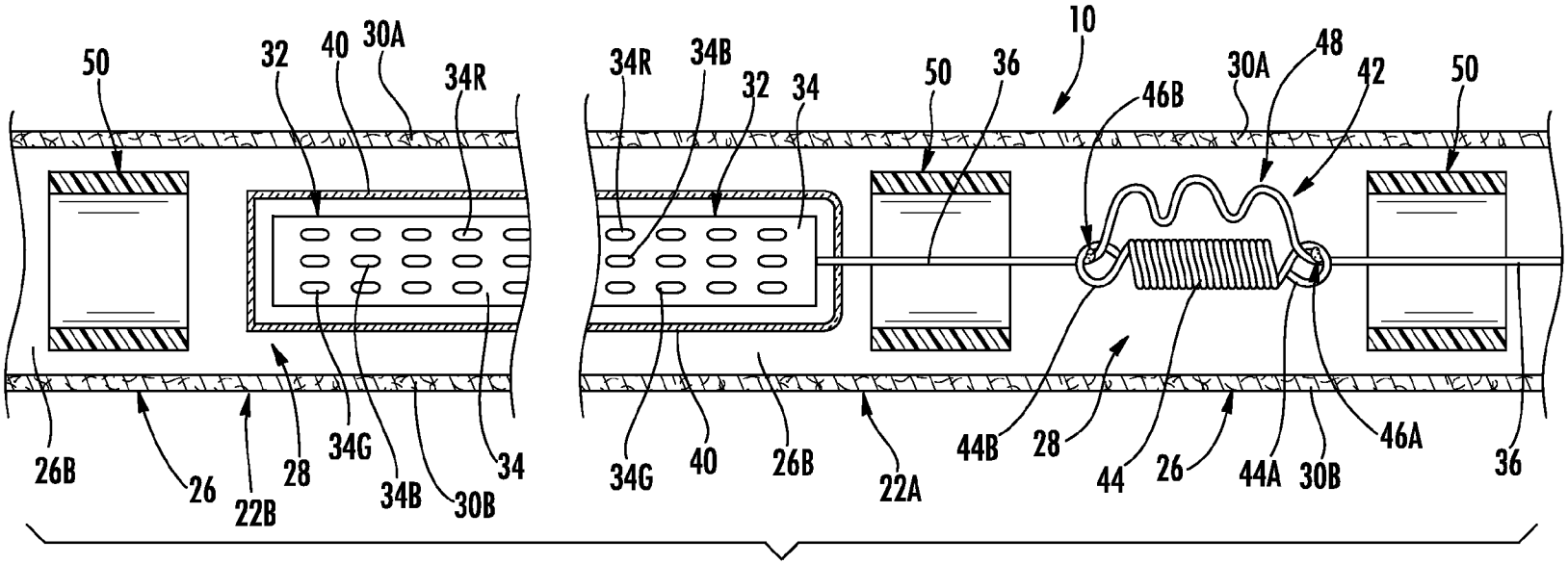
FIG. 4 is a cutaway view of the illuminated central area of the slackline shown in FIG. 1 and is also a cross sectional view taken along line 4-4 of FIG. 2; and, FIG. 5 is a perspective view of the terminal end loop of the slackline and showing in dash lines the power cord extending therethrough.

As shown in FIG. 4, a tension relief device 42 is provided in the elongate space 28 between the loop 14A and the light emitting device 32 for relieving tension in the power cord 36. Device 42 includes an extension spring 44 with terminal loop ends 44A, 44B. The power cord 36 is secured to the respective spring loop ends 44A, 44B at respective attachment points 46A, 46B with an adhesive, frictional engagement clips, and/or other suitable means. Slack is provided in the power cord portion 48 between the attachment points 46A, 46B. That is, the length of the power cord portion 48 between the attachment points 46A, 46B is longer than the length of the spring 44 between the attachment points 46A, 46B when the spring 44 is not extended as shown. As should now be appreciated, however, if the power cord 36 between the loop 14A and the light emitting device 32 is placed in tension, spring 44 will expand and thereby relieve the tension and prevent potential damage thereto.

Hollow cylinder members 50 are also preferably provided within the elongate tube space 28 as shown to help reduce friction between the power cord 36 and/or the LED's strip 34 and the interior surface of the tube 26. Cylinder members are preferably made of PVC.

Figure 5:
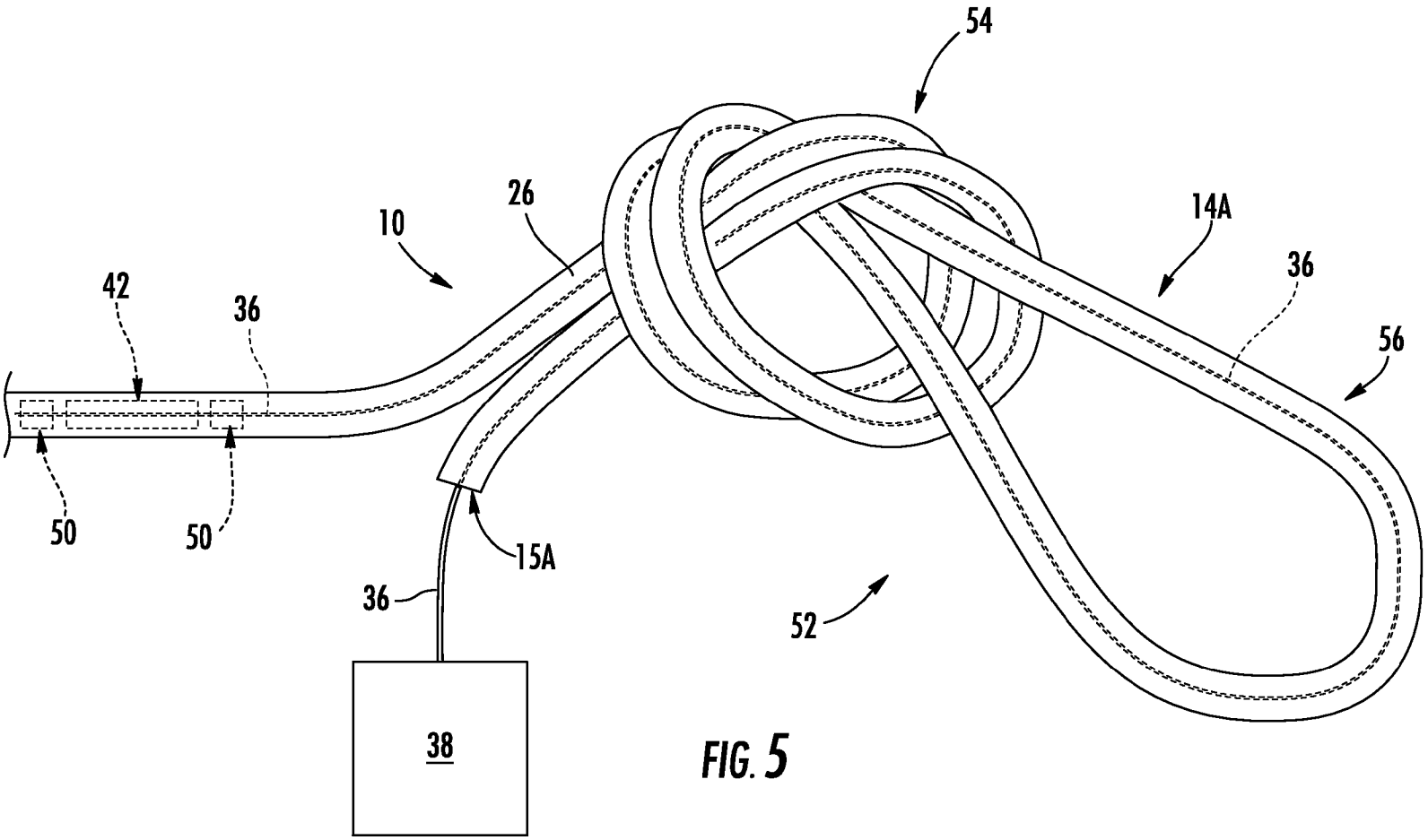

As shown in FIG. 5, the power cord 36 extends from the tension relief device 42 through the tube elongate space 28 and tube wall 26 portion which is adjacent the open terminal end 15A and which is formed into the loop 14A. More particularly, loop 14A (as well as loop 14B) is preferably an overhand loop 52 made by tying an overhand knot 54 in the bight 56. The power cord 36 which is shown in dash lines follows the curvatures and formation of the elongate tube 26 to the tube terminal open end 15A. Hence, when the knot 54 is tightened, the power cord 36 maintains a smooth transition through the tube 26 and the integrity and reliability of the conductors therein is maintained. It is noted that tape (not shown) can also be wrapped around the tube 26 portion forming the bight/loop 56 for enhancing strength and longevity in a known and customary manner.

As should now be appreciated, the slackline structure as describe hereinabove prevents potential damage of the LED's strip 34 by allowing the LED's strip 34 to longitudinally slide within the elongate tube 26. More particularly, as person 24 balances on the slackline 10, weight is placed on the slackline 10 thereby placing a downward force F thereon in the illuminated central area 20. This force can cause the LED's strip 34 and elongate tube wall 26 to become frictionally engaged specifically at the location whereat the force F is applied. Additionally, the force F causes the slackline 10/tube 26 on either side of the force F elastically elongate relative to the LED's strip 34. If the LED's strip 34 is incapable of elastic elongation, the LED's strip 34 and friction reducing tube 40 will slide relative to the elastically elongated tube 26. Additionally, if the power cord 36 is incapable of elastic elongation and tension is placed on the cord 36 and/or the LED's strip 34, the tension relief device 42 will expand and provide relief. Hence, neither the LED's strip 34 nor the power cord 36 experience potentially damaging tension.

Of course, it is contemplated that the light emitting device 32/LED's strip 34 and/or the power cord 36 can specifically be made to withstand elongation without damage such that a light emitting device 32 can be used by simply placing within the slackline tube 26 without the need for a friction reducing tube 40 and/or a tension relief device 42. It is further contemplated that the power source/lighting power control device 38 can be located within the elongate enclosed space 28 thereby obviating the need to run the power cord 36 through the terminal loop 14A.

While this invention has been described as having an exemplary design, the present invention may be further modified within the spirit and scope of this disclosure. This application is therefore intended to cover any variations, uses, or adaptations of the invention using its general principles.

What is claimed is:

1. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, wherein said tube wall is flattened defining a pair of adjacent parallel elongate walls between and joined along elongate fold lines.

2. The slackline of claim 1 wherein said light emitting device comprises an elongate strip of a plurality of LEDs.

3. The slackline of claim 1 wherein said light emitting device is elongate and is received within a friction reducing translucent tube.

4. The slackline of claim 1 further comprising an electric power source connected to said light emitting device with an electric power cord extending through said elongate tube.

5. The slackline of claim 1 further comprising a lighting power control device connected to said light emitting device and selectively providing power to said light emitting device, wherein one or more of an intensity, color and frequency of the light being emitted is selectively altered.

6. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall;

an electric power source connected to said light emitting device with an electric power cord extending through said elongate tube;

an extension spring secured at its ends to respective first and second attachment points along said power cord; and, wherein the length of the power cord between said attachment points is longer than the length of the spring between said attachment points when said spring is not extended.

7. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, an electric power source connected to said light emitting device with an electric power cord extending through an open end of said elongate tube and through said elongate tube, said elongate tube and power cord extending therethrough adjacent said open end being tied into a loop.

8. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, wherein said elongate tube is longitudinally elastic.

9. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, a tensioning device between one end of said elongate tube and one of said anchors.

10. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, wherein said elongate tube wall:

is flattened defining a pair of adjacent parallel elongate walls between and joined along elongate fold lines; and, is made of one or more of woven nylon and polyester.

11. The slackline of claim 10 wherein said light emitting device comprises an elongate strip of a plurality of LEDs.

12. The slackline of claim 11 wherein said elongate strip of a plurality of LEDs is received within a friction reducing translucent tube.

13. The slackline of claim 11 further comprising:

an electric power source connected to said elongate strip of a plurality of LEDs with an electric power cord extending through said elongate tube;

an extension spring secured at its ends to respective first and second attachment points along said power cord; and, wherein the length of the power cord between said attachment points is longer than the length of the spring between said attachment points when said spring is not extended.

14. The slackline of claim 11 further comprising an electric power source connected to said elongate strip of a plurality of LEDs with an electric power cord extending through an open end of said elongate tube and through said elongate tube, said elongate tube and power cord extending therethrough adjacent said open end being tied into a loop for attachment to said anchor.

15. The slackline of claim 11 further comprising a lighting power control device connected to said elongate strip of a plurality of LEDs and selectively providing power thereto wherein one or more of an intensity, color and frequency of the light being emitted is selectively altered.

16. The slackline of claim 11 further comprising a tensioning device between one end of said elongate tube and one of said anchors.

17. The slackline of claim 11 further comprising:

an electric power source connected to said elongate strip of a plurality of LEDs with an electric power cord extending through an open end of said elongate tube and through said elongate tube, said elongate tube and power cord extending therethrough adjacent said open end being tied into a loop for attachment to said anchor;

an extension spring secured at its ends to respective first and second attachment points along said power cord located between said loop and said elongate strip of a plurality of LEDs; and, wherein the length of the power cord between said attachment points is longer than the length of the spring between said attachment points when said spring is not extended.

18. The slackline of claim 17 wherein said electric power source includes a lighting control device wherein one or more of an intensity, color and frequency of the light being emitted is selectively altered.

19. The slackline of claim 17 further comprising a tensioning device between one end of said elongate tube and one of said anchors.

20. The slackline of claim 17 wherein said light emitting device is received within a friction reducing translucent tube.

21. A slackline for securing to and tensioning between two anchors for a person to balance thereon, said slackline comprising:

an elongate tube formed by a translucent wall defining an elongate enclosed space; and, a light emitting device within said elongate enclosed space whereby light emitted by said device travels through said tube wall; and, wherein:

one end of said elongate tube is secured to a first anchor and the other end of said elongate tube is secured to a second anchor;

said elongate tube is tensioned between said anchors; and, a person balances on said elongate tube while light is emitted by said device and travels through said elongate tube wall.

22. The slackline of claim 21 wherein said elongate tube wall:

is flattened defining a pair of adjacent parallel elongate walls between and joined along elongate fold lines; and, is made of one or more of woven nylon and polyester.

23. The slackline of claim 22 wherein said light emitting device comprises an elongate strip of a plurality of LEDs.

24. The slackline of claim 23 further comprising:

an electric power source connected to said elongate strip of a plurality of LEDs with an electric power cord extending through an open end of said elongate tube and through said elongate tube, said elongate tube and power cord extending therethrough adjacent said open end being tied into a loop for attachment to said anchor;

an extension spring secured at its ends to respective first and second attachment points along said power cord located between said loop and said elongate strip of a plurality of LEDs; and, wherein the length of the power cord between said attachment points is longer than the length of the spring between said attachment points when said spring is not extended.

25. The slackline of claim 24 wherein said electric power source includes a lighting control device wherein one or more of an intensity, color and frequency of the light being emitted is selectively altered.

26. The slackline of claim 24 further comprising a tensioning device between one end of said elongate tube and one of said anchors.

27. The slackline of claim 24 wherein said light emitting device is received within a friction reducing translucent tube.

* * * * *